US011535042B1

(12) United States Patent
Liu et al.

(10) Patent No.: US 11,535,042 B1
(45) Date of Patent: Dec. 27, 2022

(54) DEVICE FOR PRINTING TWO-DIMENSIONAL CODE IDENTIFIERS IN INTELLIGENT MANUFACTURING SYSTEM

(71) Applicant: CITIC DICASTAL CO., LTD., Hebei Province (CN)

(72) Inventors: Weidong Liu, Hebei Province (CN); Shiwen Xu, Hebei Province (CN); Zuo Xu, Hebei Province (CN); Minglei Li, Hebei Province (CN); Lisheng Wang, Hebei Province (CN)

(73) Assignee: CITIC DICASTAL CO., LTD., Hebei (CN)

( * ) Notice: Subject to any disclaimer, the term of this patent is extended or adjusted under 35 U.S.C. 154(b) by 0 days.

(21) Appl. No.: 17/409,510

(22) Filed: Aug. 23, 2021

(30) Foreign Application Priority Data

Jun. 10, 2021 (CN) ..... 202121294487.0

(51) Int. Cl.

| | |
|---|---|
| ***B41J 2/44*** | (2006.01) |
| ***B41J 3/407*** | (2006.01) |
| ***B41J 3/413*** | (2006.01) |
| ***B41F 17/00*** | (2006.01) |

(52) U.S. Cl.
CPC ..... *B41J 2/442* (2013.01); *B41F 17/002* (2013.01); *B41F 17/006* (2013.01); *B41J 3/4073* (2013.01); *B41J 3/413* (2013.01)

(58) Field of Classification Search
CPC ..... B41J 2/442; B41J 3/4073; B41J 3/413; B41F 17/002; B41F 17/006
See application file for complete search history.

(56) References Cited

U.S. PATENT DOCUMENTS

2017/0182761 A1* 6/2017 Xue ..... B44B 1/02

FOREIGN PATENT DOCUMENTS

CN 207239445 U * 4/2018

* cited by examiner

*Primary Examiner* — Matthew Luu
*Assistant Examiner* — Kendrick X Liu

(57) ABSTRACT

A device for printing two-dimensional code identifiers in an intelligent manufacturing system is composed of a clamping and positioning part and a two-dimensional code printing part. The invention can meet the demand for printing two-dimensional code identifiers in an intelligent manufacturing system, and has ideal effects and high efficiency. The operation is safe and reliable, with high degree of automation, and is especially suitable for mass production on the production line.

1 Claim, 1 Drawing Sheet

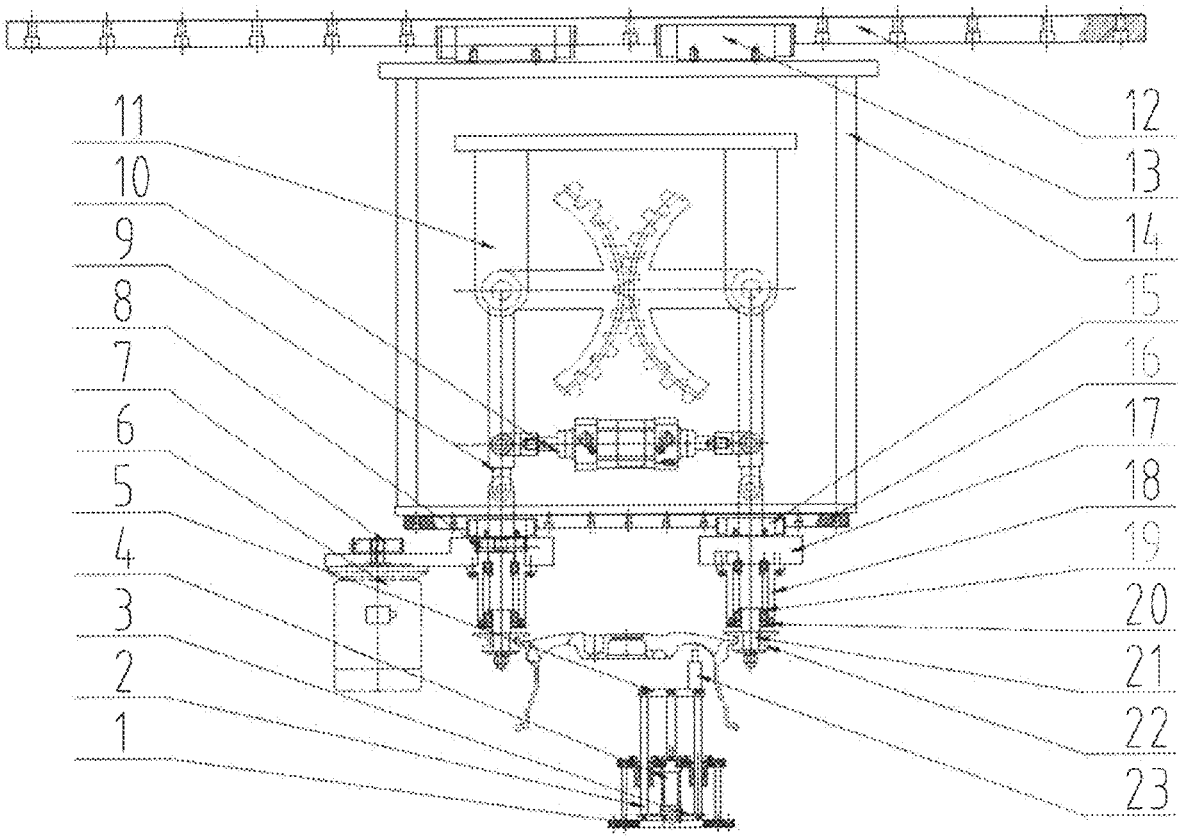
11
10
9
8
7
6
5
4
3
2
1
12
13
14
15
16
17
18
19
20
21
22
23

DEVICE FOR PRINTING TWO-DIMENSIONAL CODE IDENTIFIERS IN INTELLIGENT MANUFACTURING SYSTEM

CROSS REFERENCE TO RELATED APPLICATIONS

This patent application claims the benefit of Chinese Patent Application with Ser. No. 2021212944870 filed on Jun. 10, 2021, which is incorporated by reference herein.

TECHNICAL FIELD

The invention relates to a device for printing two-dimensional code identifiers in an intelligent manufacturing system, in particular to a device for realizing wheel clamping and positioning through a high-precision synchronous gear, and finally completing printing two-dimensional code on the wheel.

BACKGROUND

Aluminum alloy wheel manufacturing is mainly based on casting, which mainly comprises casting, machining, and coating, meeting the diversified market demand with the characteristics of low-carbon, safety, and aesthetics. In recent years, the output of aluminum alloy wheels in China has jumped to more than 60% thereof in the world. The types of traditional wheel shapes are limited, dominated by gray painted surfaces. With the development of the automobile industry, the current market demands for a variety of wheel shapes and color combinations; in the face of above changes, traditional manufacturing can only respond by adding more production lines, and due to the discontinuous process steps, many process changes and complex material levels in the traditional production methods, the main processes of casting, machining and coating must rely on manual adjustment of parameters, off-line manual detection, data delay and unclosed loops, resulting in problems such as fluctuations in production planning and product quality, backlog and difficult traceability of in-process products and so on. The whole process intelligent manufacturing system for aluminum alloy wheels uses wheel QR codes for marking, tracking, identification, and tracing, and finally realizes the whole process intelligent manufacturing of wheels.

SUMMARY OF THE INVENTION

The purpose of the invention is to provide a device for printing two-dimensional code identifiers in an intelligent manufacturing system.

To realize the above purpose, the technical scheme of the present invention is that the device for printing two-dimensional code identifiers in the intelligent manufacturing system is composed of a clamping and positioning part and a two-dimensional code printing part.

The said clamping and positioning part is composed of a left-right symmetrical clamping mechanism, comprising a synchronous wheel A, a synchronous wheel B, a gear arm, a clamping cylinder, a support, a linear guide rail A, a guide rail slide A, a mounting frame, a guide rail slide B, a linear guide rail B, a connecting plate, a sleeve, a bearing, a gland, a rotating shaft and a rotating roller.

The said clamping and positioning part is composed of a left-right symmetrical clamping mechanism, wherein the mounting frame is mounted on the linear guide rail A through the guide rail slide A; the linear guide rail B is fixed on the mounting frame, and the connecting plate is mounted on the linear guide rail B through the guide rail slide B; the sleeve is fixed on the lower end surface of the connecting plate, the rotating shaft is installed on the sleeve through the gland and the bearing, and the rotating roller is fixed on the lower end of the rotating shaft;

the said left-right symmetrical clamping mechanism is connected by a gear arm and a clamping cylinder, two ends of the gear arm are respectively hinged with the upper end part of the connecting plate and the support, the gears of the left and right gear arms are partially engaged, and the two output shafts of the clamping cylinder are respectively connected with the left and right gear arms.

In the clamping mechanism on the left side of the clamping positioning part, the synchronous wheel A is installed at the upper end of the rotating shaft, the motor is installed on the connecting plate, and the motor can drive the rotating roller to rotate through the transmission of the synchronous gear.

The said two-dimensional code printing part comprises: a base, a guide shaft, a synchronous plate, a lifting cylinder, a linear bearing, a motor, and a laser engraving machine. The four guide shafts are uniformly arranged on the base through corresponding four linear bearings, and both ends of the guide shafts are respectively connected with a synchronous plate and a laser engraving machine; the lifting cylinder is fixed on the base, and its output shaft is connected with the laser engraving machine.

Through the linear bearing and the synchronous plate, the said lifting cylinder can drive the laser engraving machine to move up and down vertically along the linear bearing stably.

In a preferred aspect of the present invention, the gear parts of the left and right gear arms mesh with high precision, and this structure can adjust the synchronization performance of the left and right clamping mechanisms with high precision.

In actual application, the wheel moves to the clamping position of the device through the roller conveyor system, and after the clamping cylinder is ventilated, the left and right gear arms are driven to expand to both sides. through high-precision meshing of the gear parts of the left and right gear arms, four rotating rollers uniformly distributed on the left and right sides are realized to move synchronously and centripetally along the linear guide rail B with high precision, thus realizing high-precision clamping of the wheel. Then, through the position detection system of the device, the engraving area of the back cavity of the wheel spoke is detected. Then, the motor starts to work, through synchronous gear transmission, the motor can drive the rotating roller to rotate, under the action of friction between the rotating roller and the wheel, the wheel starts to rotate, turning the engraving area of the back cavity of the wheel to the working area of the laser engraving machine. Through the linear bearing and the synchronous plate, the lifting cylinder can drive the laser engraving machine to move vertically upward along the linear bearing to the position where the QR code is printed on the wheel, and at the same time, the laser engraving machine completes printing the QR code.

The invention can meet the demand for printing two-dimensional code identifiers in an intelligent manufacturing system, and has ideal effects and high efficiency. The operation is safe and reliable, with high degree of automation, and is especially suitable for mass production on the production line.

BRIEF DESCRIPTION OF THE DRAWINGS

FIG. 1 is a structural schematic diagram of a device for printing two-dimensional code identifiers in an intelligent manufacturing system of the present invention.

In the FIGURE, 1—base, 2—guide shaft, 3—synchronous plate, 4—lifting cylinder, 5—linear bearing, 6—motor, 7—synchronous wheel A, 8—synchronous wheel B, 9—gear arm, 10—clamping cylinder, 11—support, 12—linear guide rail A, 13—guide rail slide A, 14—mounting frame, 15—guide rail slide B, 16—linear guide rail B, 17—connecting plate, 18—sleeve, 19—bearing, 20—gland, 21—rotating shaft, 22—rotating roller, 23—laser engraving machine.

DESCRIPTION OF THE EMBODIMENTS

The details and operation of the specific device according to the present invention will be described in detail below with reference to the accompanying drawings.

The device for printing two-dimensional code identifiers in the intelligent manufacturing system is composed of a clamping and positioning part and a two-dimensional code printing part. The said clamping and positioning part is composed of a left-right symmetrical clamping mechanism, comprising a motor 6, a synchronous wheel A 7, a synchronous wheel B 8, a gear arm 9, a clamping cylinder 10, a support 11, a linear guide rail A 12, a guide rail slide A 13, a mounting frame 14, a guide rail slide B 15, a linear guide rail B 16, a connecting plate 17, a sleeve 18, a bearing 19, a gland 20, a rotating shaft 21 and a rotating roller 22. The mounting frame 14 is mounted on the linear guide rail A 12 through the guide rail slide A 13; The linear guide rail B 16 is fixed on the mounting frame 14, and the connecting plate 17 is mounted on the linear guide rail B 16 through the guide rail slide B 15; The sleeve 18 is fixed on the lower end surface of the connecting plate 17, the rotating shaft 21 is installed on the sleeve 18 through the gland 20 and the bearing 19, and the rotating roller 22 is fixed on the lower end of the rotating shaft 21.

The said left-right symmetrical clamping mechanism is connected by a gear arm 9 and a clamping cylinder 10, two ends of the gear arm 9 are respectively hinged with the upper end part of the connecting plate 17 and the support 11, the gears of the left and right gear arms 9 are partially engaged, and the two output shafts of the clamping cylinder 10 are respectively connected with the left and right gear arms 9.

In the clamping mechanism on the left side of the said clamping positioning part, the synchronous wheel A 7 is installed at the upper end of the rotating shaft 21, the motor 6 is installed on the connecting plate 17, and the motor 6 can drive the rotating roller 22 to rotate through the transmission of the synchronous gear.

The two-dimensional code printing part comprises: a base 1, a guide shaft 2, a synchronous plate 3, a lifting cylinder 4, a linear bearing 5, and a laser engraving machine 23. The four guide shafts 2 are uniformly arranged on the base 1 through corresponding four linear bearings 5, and both ends of the guide shafts 2 are respectively connected with a synchronous plate 3 and a laser engraving machine 23; the lifting cylinder 4 is fixed on the base 1, and its output shaft is connected with the laser engraving machine 23.

Through the linear bearing 5 and the synchronous plate 3, the said lifting cylinder 4 can drive the laser engraving machine 23 to move up and down vertically along the linear bearing 5 stably.

In a preferred aspect of the present invention, the gear parts of the left and right gear arms 9 mesh with high precision, and this structure can adjust the synchronization performance of the left and right clamping mechanisms with high precision.

In actual application, the wheel moves to the clamping position of the device through the roller conveyor system, and after the clamping cylinder 10 is ventilated, the left and right gear arms 9 are driven to expand to both sides, through high-precision meshing of the gear parts of the left and right gear arms 9, four rotating rollers 22 uniformly distributed on the left and right sides are realized to move synchronously and centripetally along the linear guide rail B 16 with high precision, thus realizing high-precision clamping of the wheel. Then, through the position detection system of the device, the engraving area of the back cavity of the wheel spoke is detected. Then, the motor 6 starts to work, through synchronous gear transmission, the motor 6 can drive the rotating roller 22 to rotate, under the action of friction between the rotating roller and the wheel, the wheel starts to rotate, turning the engraving area of the back cavity of the wheel to the working area of the laser engraving machine 23. Through the linear bearing 5 and the synchronous plate 3, the lifting cylinder 4 can drive the laser engraving machine 23 to move vertically upward along the linear bearing 5 to the position where the QR code is printed on the wheel, and at the same time, the laser engraving machine 23 completes printing the QR code.

We claim:

1. A device for printing two-dimensional code identifiers in an intelligent manufacturing system, composed of a clamping and positioning part and a two-dimensional code printing part, characterized in that the clamping and positioning part is composed of a left-right symmetrical clamping mechanism, comprising a motor, a synchronous wheel A, a synchronous wheel B, a gear arm, a clamping cylinder, a support, a linear guide rail A, a guide rail slide A, a mounting frame, a guide rail slide B, a linear guide rail B, a connecting plate, a sleeve, a bearing, a gland, a rotating shaft, a rotating roller, the mounting frame mounted on the linear guide rail A through the guide rail slide A; the linear guide rail B fixed on the mounting frame, and the connecting plate mounted on the linear guide rail B through the guide rail slide B; the sleeve fixed on the lower end surface of the connecting plate, the rotating shaft installed on the sleeve through the gland and the bearing, and the rotating roller fixed on the lower end of the rotating shaft;

Wherein the two-dimensional code printing part comprises a base, a guide shaft, a synchronous plate, a lifting cylinder, a linear bearing and a laser engraving machine, four guide shafts uniformly arranged on the base through the corresponding four linear bearings, and two ends of the guide shaft respectively connected with the synchronous plate and the laser engraving machine; the lifting cylinder fixed on the base, and its output shaft connected with the laser engraving machine.

* * * * *